United States Patent [19]

Hayashi

[11] Patent Number: 4,567,858

[45] Date of Patent: Feb. 4, 1986

[54] LOAD RESPONSIVE TEMPERATURE CONTROL ARRANGEMENT FOR INTERNAL COMBUSTION ENGINE

[75] Inventor: Yoshimasa Hayashi, Kamakura, Japan

[73] Assignee: Nissan Motor Co., Ltd., Yokohama, Japan

[21] Appl. No.: 640,140

[22] Filed: Aug. 13, 1984

[30] Foreign Application Priority Data

Aug. 18, 1983 [JP] Japan ..... 58-149538

[51] Int. Cl.[4] ..... F01P 3/22

[52] U.S. Cl. ..... 123/41.13; 123/41.21; 123/41.44; 123/41.49

[58] Field of Search ..... 123/41.12, 41.13, 41.2, 123/41.21, 41.44, 41.49

[56] References Cited

U.S. PATENT DOCUMENTS

| | | | |
|---|---|---|---|
| 1,376,086 | 4/1921 | Fairman | 123/41.14 |
| 1,787,562 | 1/1931 | Barlow | 123/41.44 |
| 2,420,436 | 5/1947 | Mallory | 123/173 |
| 4,275,688 | 6/1981 | Abe et al. | 123/41.12 |
| 4,367,699 | 1/1983 | Evans | 123/41.23 |
| 4,475,485 | 10/1984 | Sakakibara et al. | 123/41.12 |

FOREIGN PATENT DOCUMENTS

| | | | |
|---|---|---|---|
| 0059423 | 9/1982 | European Pat. Off. . | |
| 56-32025 | 1/1981 | Japan . | |
| 56-32027 | 1/1981 | Japan . | |
| 57-16219 | 1/1982 | Japan . | |
| 57-195818 | 12/1982 | Japan | 123/41.12 |
| 57-57608 | 12/1982 | Japan . | |

*Primary Examiner*—William A. Cuchlinski, Jr.
*Attorney, Agent, or Firm*—Schwartz, Jeffery, Schwaab, Mack, Blumenthal & Evans

[57] ABSTRACT

In an engine wherein the coolant is boiled and the vapor thereof used as a vehicle for removing heat, engine load is sensed and a fan, or like device, suitably operated to cool a radiator in a manner that the rate of vapor condensation therein is controlled to cause the pressure (and therefore the temperature) prevailing in the coolant jacket to rise to a level which promotes fuel economy during so called "urban cruising" and caused to drop for high speed and/or high load (e.g. hill climbing) to improve charging efficiency, avoid engine knocking etc. When the engine changes from high speed/load operation to "urban cruising", the rate of condensation in the radiator is maintained at that suitable for high speed/load operation for a short period to remove the heat accumulated in the engine and obviate a sudden temperature and pressure increase in the cooling system which would otherwise tend to occur upon the switch to "urban cruising" control.

7 Claims, 5 Drawing Figures

LOAD RESPONSIVE TEMPERATURE CONTROL ARRANGEMENT FOR INTERNAL COMBUSTION ENGINE

BACKGROUND OF THE INVENTION

1. Field of the Invention

The present invention relates generally to an internal combustion engine of the type wherein coolant is boiled to make use of the latent heat of vaporization of the coolant and the coolant vapor used as a heat transfer medium, and more specifically to an improved temperature control arrangement therefor which can adjust the engine temperature appropriately in response to engine load and particularly to sudden changes thereof.

2. Description of the prior art

In currently used "water cooled" internal combustion engines, the engine coolant (liquid) is forcefully circulated by a water pump through a circuit including the engine coolant jacket and a radiator (usually fan cooled). However, in this type of system a drawback is encountered in that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having 1800 cc displacement (by way of example) is operated at full throttle, the cooling system is required to remove approximately 4000 Kcal/h. In order to acheive this a flow rate of 167 l/min (viz., $4000-60\times\frac{1}{4}$) must be produced by the water pump. This of course undesirably consumes a number of horsepower.

Moreover, with the above type of engine cooling system, the temperature of the coolant is prevented from boiling and maintained within a predetermined narrow temperature range irrespective of the load and/or mode of operation of the engine, despite the fact that it is advantageous from the point of fuel economy to raise the temperature of the engine during low-medium load "urban" cruising and reduce same during high speed and/or high load (full throttle) modes of operation for engine protection.

One arrangement via which the temperature of the engine may be varied in response to load is disclosed in U.S. Pat. No. 2,420,436 issued on May 1947 in the name of Mallory. This document discloses an arrangement wherein the volume of water in the cooling system is increased and decreased in response to engine temperature and load. However, with this arrangement only the water level in the radiator is varied while the water jacket, formed in the cylinder block and cylinder head, remains full under the influence of a water circulation pump. Accordingly, this arrangement has suffered from the drawback that a power consuming water circulation pump is required, the temperature by which the temperature can be increased is limited by the fact that the water is prevented from boiling and in that the notable mass of water increases the weight and warm-up time of the engine.

Another arrangement of achieving the desired temperature control has included the use of a "dual" cooling system including two radiators which can be selectively used in response to engine load. However, the weight of such a system is prohibitive while simultaneously incurring the drawbacks of slow warmup and limited temperature variation range.

SUMMARY OF THE INVENTION

It is an object of the present invention to provide an arrangement which obivates the use of a water circulation pump of the nature used in conventional engines, which can, in response to various modes of engine operation, readily raise and lower the temperature of the engine to required degrees and which prevents "thermal overshoot" which tends to occur upon sudden reductions in load.

In brief, this object is fullfilled by using a cooling system wherein the coolant is boiled and the vapor used as a vehicle for removing engine heat, engine load is sensed and a fan, or like device, suitably operated to cool a radiator in a manner that the rate of vapor condensation therein is controlled to cause the pressure (and therefore the temperature) prevailing in the coolant jacket to rise to a level which promotes fuel economy during so called "urban cruising" (low load) and caused to drop for high speed and/or high load (e.g. hill climbing) to improve charging efficiency, avoid engine knocking, damage etc. Further, with the present invention, when the engine changes from high speed/load operation to "urban cruising", the rate of condensation in the radiator is maintained at that suitable for high speed/load operation for a short period to provide time enough for the heat accumulated in the engine to be removed and thus obviate a sudden temperature and pressure increase (viz,. the above mentioned "thermal overshoot") in the cooling system which would otherwise tend to occur upon the switch back to load load ("urban cruising") control.

More specifically, the present invention takes the form of an internal combustion engine which features a radiator, a coolant jacket in which coolant is boiled and the vapor produced condensed in the radiator, a sensor for sensing a first parameter which varies with the load on the engine, and an arrangement responsive to the sensor for inducing a first rate of condensation in the radiator which maintains the temperature of the coolant in the coolant jacket below a predetermined temperature when the first sensor indicates the load on the engine is above a predetermined level and for inducing a second rate of condensation which maintains the temperature of the coolant in the coolant jacket above the predetermined temperature when the first sensor indicates the load on the engine is below the predetermined level, and a delay which maintains the first rate of condensation for a period after the load sensed by the first sensor falls below the predetermined level.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Figure 1:
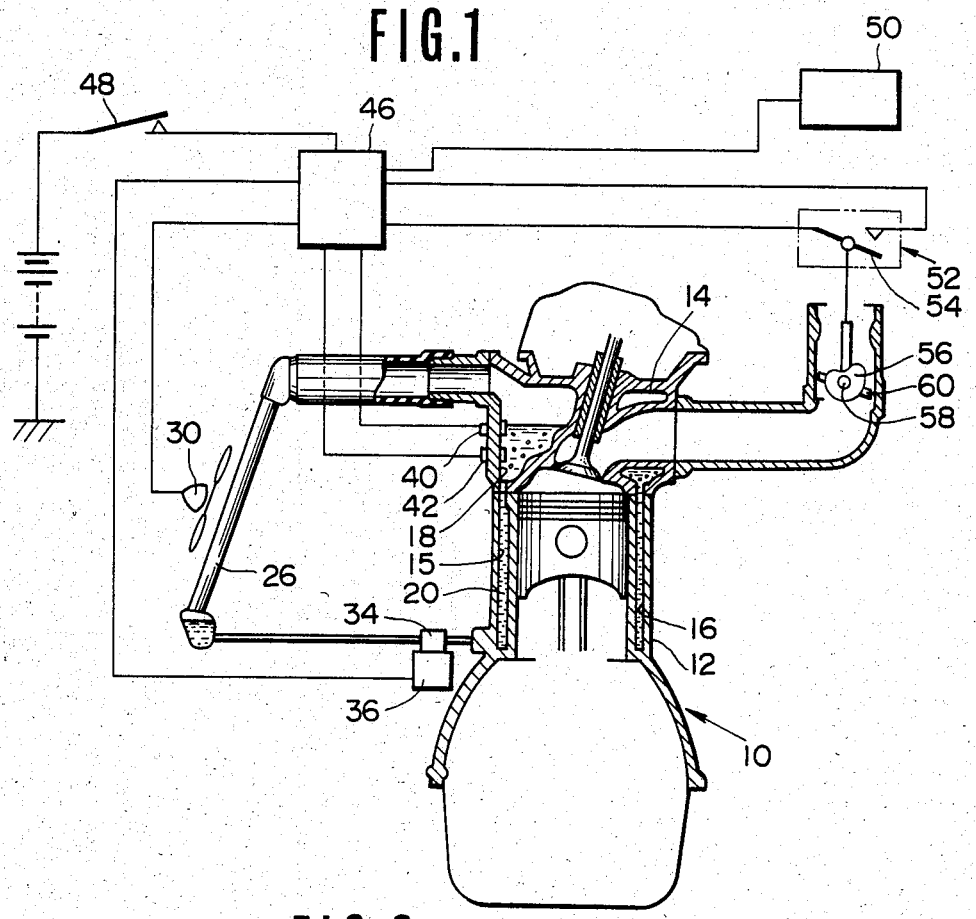
FIG. 1 is a schematic diagram of an engine system incorporating the present invention.

FIG. 1 shows an engine system incorporating the present invention. In this arrangement an internal combustion engine 10 includes a cylinder block 12 on which a cylinder head 14 is detachably secured. The cylinder head and cylinder block include suitable cavities 15–18 which define a coolant jacket 20 about the heated portions of the cylinder head and block. In this embodiment, coolant is introduced into the coolant jacket 20 through a port 22 formed in the cylinder block 12. As shown, this port communicates with a lower level of the coolant jacket 20. Fluidly communicating with a vapor discharge port 24 of the cylinder head 12 is a radiator 26 (heat exchanger). It should be noted that the interior of this radiator is maintained essentially empty of liquid coolant during normal engine operation so as to maximize the surface area available for condensing coolant vapor (via heat exchange with the ambient atmosphere) and that the cooling system as a whole (viz., coolant jacket, radiator etc.) is hermetically sealed.

If deemed advantageous a mesh screen or like separator (not shown) can be disposed in the vapor discharge port of the cylinder head so as to minimize the loss of liquid coolant which tends to froth during boiling.

Located suitably adjacent the radiator 26 is an electrically driven fan 30. Disposed in a coolant return conduit 32 is a return pump 34. In this embodiment, the pump is driven by an electric motor 36.

In order to control the level of coolant in the coolant jacket, a level sensor 40 is disposed as shown. It will be noted that this sensor is located at a level higher than that of the combustion chambers, exhaust ports and valves (structure subject to high heat flux) so as to maintain same securely immersed in coolant and therefore attenuate engine knocking and the like due to the formation of localized zones of abnormally high temperature or "hot spots".

Located below the level sensor 40 so as to be immersed in the liquid coolant is a temperature sensor 44. The output of the level sensor 40 and the temperature sensor 44 are fed to a control circuit 46 or modulator which is suitably connected with a source of EMF upon closure of a switch 48. This switch of course may advantageously be arranged to be simultaneously closed with the ignition switch of the engine (not shown).

The control circuit 46 further receives an input from the engine distributor 50 (or like device) indicative of engine speed and an input from a load sensing device 52 such as a throttle valve position sensor. It will be noted that as an alternative to throttle position, the output of an air flow meter or an induction vacuum sensor may used to indicate load. In the illustrated embodiment a throttle position sensor is used. This sensor takes the form of a switch 54 which is arranged to be closed by a cam 56 mounted on the throttle valve shaft 58 (for example). With this arrangement, the switch is closed upon the throttle valve 60 being rotated to a predetermined opening (35 degrees merely by way of example) representative of the boundry between high and low load modes of operation.

Figure 2:
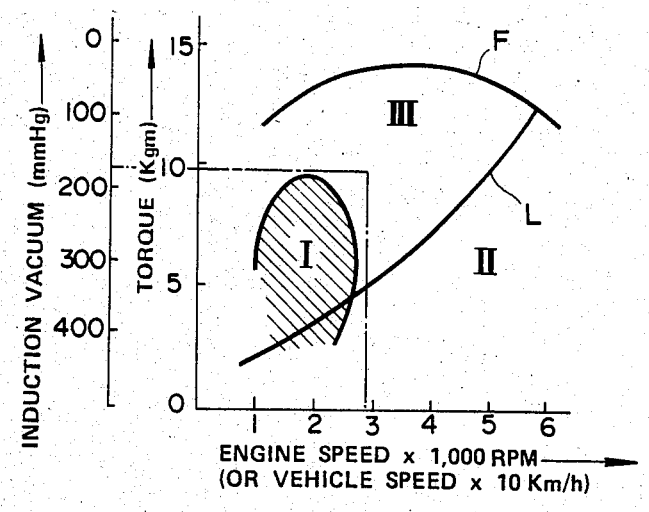
FIG. 2 is a graph, plotted in terms load (torque or induction vacuum) and engine speed, showing the various load zones in which temperature control is required.

FIG. 2 graphically shows in terms of engine torque and engine speed the various load "zones" which are encountered by an automotive vehicle engine. In this graph, the the curve F denotes full throttle torque characteristics, trace L denotes the resistance encountered when a vehicle is running on a level surface, and zones I, II and III denote respectively "urban cruising", "high speed cruising" and "high load operation" (such as hillclimbing, towing etc.).

A suitable coolant temperature for zone I is approximately 110 degrees C. while 90–80 degrees for zones II and III. The high temperature during "urban cruising" of course promotes improved fuel economy while the lower temperatures promote improved charging efficiency while simultaneously obviating engine knocking and/or engine damage in the other zones. For operational modes which fall between the aforementioned first, second and third zones, it is possible to maintain the engine coolant temperature at approximately 100 degrees C.

With the present invention, in order to control the temperature of the engine, the embodiment thereof takes advantage of the fact that with a cooling system wherein the coolant is boiled and the vapor used a heat transfer medium, the amount of coolant actually circulated between the coolant jacket and the radiator is very small, the amount of heat removed from the engine per unit volume of coolant is very high and upon boiling, the pressure prevailing within the coolant jacket and consequently the boiling point of the coolant rises due to the closed nature of the system employed. Thus, by circulating only a predetermined flow of cooling air over the radiator, it is possible reduce the rate of condensation therein and cause the pressure within the cooling system to rise above atmospheric and thus induce the situation wherein the engine coolant boils at temperatures above 100 degrees C.—for example at approximately 119 degrees C. (corresponding to a pressure of approximately 1.9 Atmospheres). On the other hand, during high speed cruising, it is further possible by increasing the rate of condensation within the radiator to a sufficiently high level, to increase the amount of heat removed from the engine and to reduce the pressure prevailing in the cooling system below atmospheric and thus induce the situation wherein the coolant boils at temperatures in the order of 80 to 90 degrees C.

During high speed cruising, the natural air draft produced under such conditions may be sufficient to require only infrequent energizations of the fan to induce a condensation rate which reduces the pressure in the coolant jacket to the aformentioned subatmospheric levels and therefore lower the engine temperature to between 100 and 80 degrees C. (for example). Of course during hillclimbing, towing and the like, the fan may be frequently energized to achieve the desired low temperature.

However, upon a sudden change from high load operation to that which characterizes "urban cruising" for example, because the pressure within the coolant jacket can be very quickly increased (and decreased) with the present invention, it is necessary to provide sufficient time for the heat which has accumulated in the engine and associated structure during high load operation to be removed, before actually entering the mode of operation which will boost the coolant boiling point to 110–120 degrees, and thus obviate the tendancy for the coolant boiling point to overshoot to temperatures well in excess of those intended due to the presence of an unexpectely large amount of heat which would otherwise tend to get "trapped" in the system. Thus, the invention includes a delay which delays the change from the high load cooling mode to the low or "urban cruising" one, for a period of time sufficient to permit the removal of the "excess" heat after the load on the engine has actually lowered.

Figure 3:
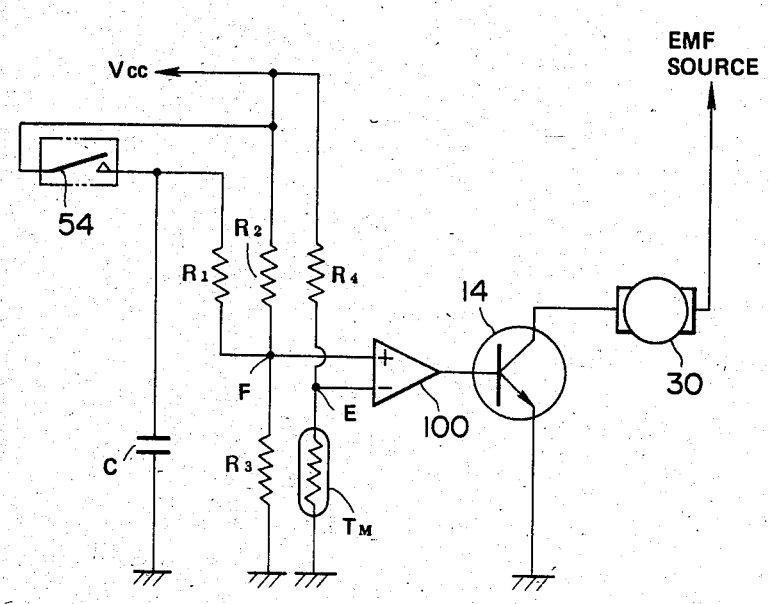
FIG. 3 is a circuit diagram showing circuitry which characterizes the control system of a first embodiment of the present invention.

FIG. 3 shows an example of circuitry which is simple and which can be used to control the operation of the fan in a manner to achieve both the rate of condensation which will maintain the desired temperatures during the aforementioned high and load load modes of engine operation as well as enable the necessary heat removal during high-low load transitions.

As shown, this circuit utilizes the throttle position parameter alone to detect load and determine the temperature level at which the coolant should be maintained. More specifically, the circuit inlcludes a comparator 100 which receives a signal on its noninverting input (+) from the throttle switch 54 via a resistor R1. A first voltage divider consisting of series connected resistors R2,R3 is connected with the line interconnecting resistor R1 with the non-inverting input (+), at junction F. This voltage divider is connected between ground and a stablized voltage source (not shown). The inverting input (−) of the comparator 100 is connected with a second voltage divider arrangement comprised of resistor R4 and thermistor $T_M$. The latter mentioned element of course defines the heart of the temperature sensor 42. The second voltage dividing arrangement is also connected between earth and the source of stablized voltage.

The output of the comparator 100 is fed to the base of a transistor 102 connected in series with the source of EMF, the fan 30 and ground.

The delay which characterizes the present invention is provided by a capacitor C which is connected in parallel with the resistor R1 and which is charged upon closure of the throttle switch 54.

With this arrangement, when the engine is operating and the throttle valve 60 is opened to less than the previously mentioned predetermined amount (viz., 35 degrees), the throttle switch 54 remains open and the voltage applied to the non-inverting input (+) of comparator 100 is supplied via the first voltage divider. On the other hand, the voltage supplied to the inverting input (−) is supplied by the second voltage divider arrangement. This voltage of course varies with the temperature of the coolant within the coolant jacket.

Figure 4:
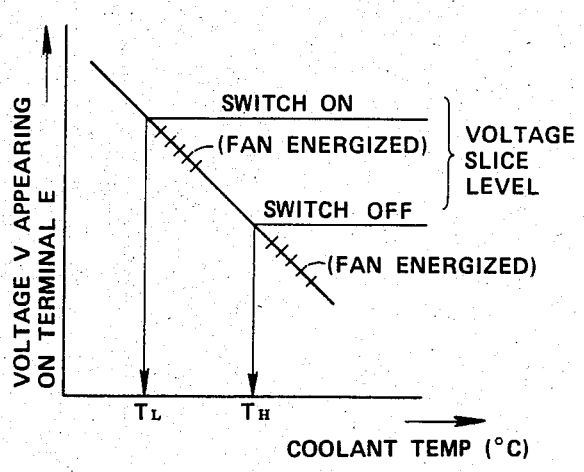
FIG. 4 is a graph showing in terms of engine coolant temperature and the voltage appearing on terminal E of the FIG. 4 arrangement, the control characteristics provided by the above mentioned circuit.

Upon the engine being subject to high load, which in this embodiment is indicated by the throttle valve being opened beyond the previously mentioned amount, the throttle switch 54 is closed, the voltage fed to the non-inverting input (+) of comparator 100 rises from the level indicated in FIG. 4 by "switch OFF" to that indicated by "switch ON" and the capacitor C becomes charged.

Accordingly, when the vehicle is operating under conditions indicated as being "urban cruising" by the throttle valve 60 being opened to less than the predetermined angle, then each time the temperature of the coolant rises about $T_H$ (see FIG. 4) the fan 30 will be energized and maintained on until the temperature falls below same. Conversely, upon the throttle being opened beyond the predetermined angle which defines the boundry between "urban cruising" and high load operation, the voltage appearing on terminal F will rise and accordingly, the fan 30 operated until the temperature of the coolant has fallen to that indicated by $T_L$ in FIG. 4. Upon the voltage outputted by the second voltage divider changing due to the coolant temperature exceeding $T_L$, the fan 30 will be again energized.

Upon a high-low load transition, the throttle switch 54 is opened due to the closure of the throttle valve 60 beyond the predetermined angle and the capacitor C begins discharging the charge stored thereon, through the resistor R1. By means of appropriate selection of the capacitor C and resistor R1, the time for which the voltage at terminal F is maintained at the level at which the high load mode of cooling is carried out, can be determined such as to permit sufficient heat to be removed from the engine, by maintaining the high load operation rate of condensation in the radiator, before the "urban cruising" mode is actually initiated.

Figure 5:
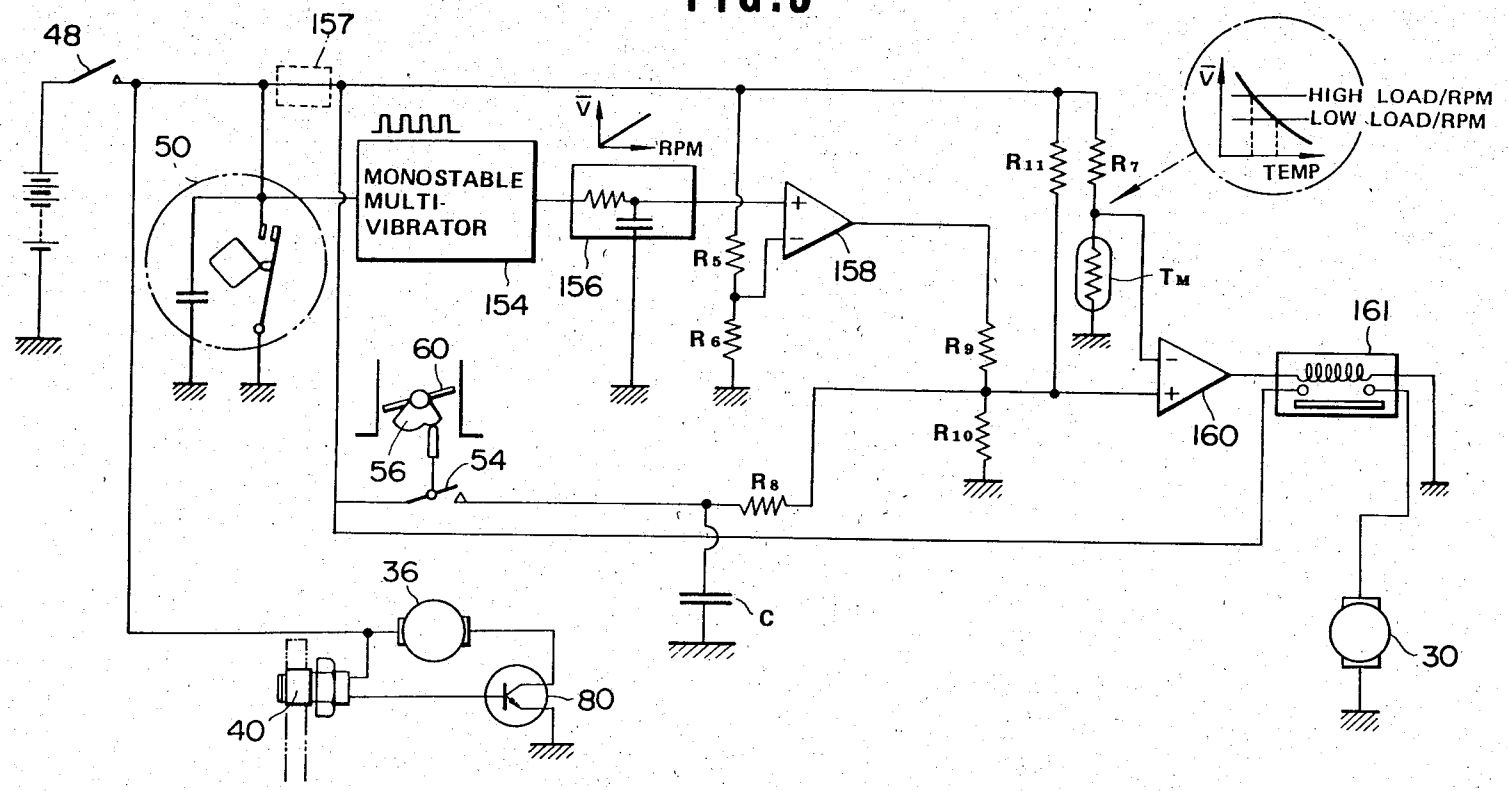
FIG. 5 is a circuit diagram showing circuitry which characterizes a second embodiment of the present invention.

FIG. 5 shows a second circuit arrangement via which the operation of the fan motor can be controlled. This circuit is responsive to both load (as indicated by a throttle switch) and engine speed. This figure further illustrates circuitry suitable for controlling the operation of the pump motor 36.

In this circuit arrangement the distributor 50 of the engine ignition system is connected with the source of EMF (FIG. 1) via the switch 48. A monostable multivibrator 154 is connected in series between the distributor 50 and a smoothing circuit 156. A DC-DC converter 157 is arranged, as shown in broken line, to ensure a supply of constant voltage to the circuit as a whole. A voltage divider consisting of resistors R5 and R6 provides a comparator 158 with a reference voltage at the inverting input (−) thereof while the non-inverting input (+) of same receives the output of the smoothing circuit 156. A second voltage dividing arrangement consisting of a resistor R7 and a thermistor $T_M$ (viz., the temperature sensor 144), applies a variable reference voltage to the inverting input (−) of a second comparator 160 which also receives on its non-inverting input (+), a signal from the cam operated throttle switch 54 via a resistor arrangement including resistors R8, R9, R10 and R11 connected as shown. The output of the comparator 160 is applied to the fan 30 via a relay 161 for energizing same.

The circuit further includes a transistor 80 which acts a switch upon receiving an output from the level sensor 40 to establish a circuit between the source of EMF and ground. As a safety measure, an inverter or the like (not shown) may be interposed between the level sensor 40 and the transistor 80, and the level sensor adapted to produce an output when immersed in coolant. With this arrangement should the level sensor malfunction, the lack of output therefrom causes the transistor 80 to be continuously rendered conductive and the pump 36 continually energized to ensure that an adequate amount of coolant is maintained in the coolant jacket.

As will be appreciated, the thus far disclosed circuit, depending on the load and engine speed, the temperature of the coolant in the coolant jacket will be adjusted in a manner that at low engine speeds and loads the voltage appearing at the inverting terminal (−) of the comparator 60 will be compared with the voltage appearing on the non-inverting terminal (+) thereof and the fan 30 suitably engergized to maintain a high temperature under so called "urban cruising" conditions and lowered at high load/speed operation.

In order to provide the delay necessary to obviate any tendancy for "thermal overshoot" to occur, a capacitor C is connected in a manner similar to that disclosed in connection with the circuit of FIG. 3. That is to say, so as to be charged upon closure of the throttle valve switch 54 and discharge the charge accumlated through resistor R8, upon opening of same. The function provided by this capacitor is the same as that previously discussed in connection with the FIG. 3 circuit so that description of same will be omitted for brevity.

What is claimed is:

1. In an internal combustion engine, a radiator;

a coolant jacket in which coolant is boiled and the vapor produced condensed in said radiator;

a first sensor for sending a first parameter which varies with the load on said engine; and a device responsive to said first sensor for inducing a first rate of condensation in said radiator which maintains the temperature at which said coolant in said coolant jacket boils below a predetermined temperature when said first sensor indicates the load on said engine is above a predetermined level and for inducing a second rate of condensation which maintains the temperature at which said coolant in said coolant jacket boils above said predetermined temperature when said first sensor indicates the load on said engine is below said predetermined level; and a delay which maintains said first rate of condensation for a period after the load sensed by said first sensor falls below said predetermined level.

2. An internal combustion engine as claimed in claim 1, which includes a combustion chamber and which further comprises:

a level sensor disposed in said coolant jacket at a level higher than said combustion chamber;

a pump disposed in a return conduit leading from said radiator to said coolant jacket for returning condensed coolant from said radiator to said coolant jacket, said pump being responsive to the output of said level sensor in a manner to maintain the level of liquid coolant at said level higher than said combustion chamber.

3. An internal combustion engine as claimed in claim 1, further comprising:

a temperature sensor for sensing the temperature of the coolant in said coolant jacket.

4. An internal combustion engine as claimed in claim 1, wherein said sensor responsive device takes the form of a fan which is selectively energized to pass a cooling draft of air over said radiator.

5. An internal combustion engine as claimed in claim 1, wherein said first parameter sensing sensor is a throttle position sensor, said throttle position sensor being arranged to indicate high load operation when the throttle valve is opened beyond a predetermined amount.

6. An internal combustion engine as claimed in claim 1, wherein said delay takes the form of a capacitor which is charged when said first parameter sensing sensor indicates high load operation and which discharges in a manner to maintain the operation of said sensor responsive arrangement for said period after said first parameter sensing sensor ceases to indicate high load operation.

7. An internal combustion engine as claimed in claim 1, wherein said sensor responsive arrangement includes:

a comparator having a first input and a second input:

a first voltage divider which supplies a first predetermined voltage to said first input;

a second voltage divider which supplies a voltage which varies with the temperature of said coolant to said second input;

a fan having a motor; and a switch responsive to the output of said comparator which completes a connection between said motor and a source of motive energy, said first input being connected with said first sensor in a manner that when said first sensor indicates the load on said engine is above said predetermined level, the voltage applied to said first input is increased to a second predetermined voltage which is higher than said first predetermined one.

* * * * *